United States Patent [19]

Sugahara et al.

[11] 4,294,142

[45] Oct. 13, 1981

[54] AUTOMATIC SCREWDRIVER

[75] Inventors: Syunji Sugahara, Osaka; Takao Morimoto, Kadoma, both of Japan

[73] Assignee: Matsushita Electric Industrial Company, Limited, Osaka, Japan

[21] Appl. No.: 111,073

[22] Filed: Jan. 10, 1980

[30] Foreign Application Priority Data

Jan. 20, 1979 [JP] Japan ..... 54-5005

[51] Int. Cl.[3] ..... B25B 23/06

[52] U.S. Cl. ..... 81/57.37

[58] Field of Search ..... 81/57.37; 144/32

[56] References Cited

U.S. PATENT DOCUMENTS 4,204,439 5/1980 Kondo ..... 81/57.37

FOREIGN PATENT DOCUMENTS 2415241 3/1974 Fed. Rep. of Germany ..... 81/57.37

1506398 4/1978 United Kingdom ..... 81/57.37

*Primary Examiner*—James L. Jones, Jr.

*Attorney, Agent, or Firm*—Lowe, King, Price & Becker

[57] ABSTRACT

An automatic power-driven screwdriver comprises a first cylindrical member having a hand grip portion, a guide portion, a tapered portion and a flanged portion between the tapered and hand grip portions. A second cylindrical member, which is a nose portion of the screwdriver, is mounted to telescope over the guide portion. A third cylindrical member encircles the guide portion and is slidably mounted at one end over the second cylindrical member. The third member is formed with a tapered contacting surface complementary to the surface of the tapered portion of the first member. An adjusting nut having an inwardly extending flange is mounted on the first member with the flange being in contact with the flanged portion and is threadably engaged with the third member so that the tapered contacting surfaces are brought into firm pressure contact which enables the first and second cylindrical members to be secured firmly together. By loosening the nut the nose portion of the apparatus can be rotated to a desired annular position with respect to the hand grip portion so that a screw feeder tube, connected to the nose portion, is not hindered by an obstacle which might be present in working areas.

3 Claims, 6 Drawing Figures

AUTOMATIC SCREWDRIVER

BACKGROUND OF THE INVENTION

The present invention relates to an automatic power-driven screwdriver comprising two generally cylindrically shaped telescoping members forming respectively a hand grip and nose portions with a power drive unit mounted in the hand grip portion to transmit rotational power to a screwdriving bit under the control of a hand-operated lever pivotally attached to the hand grip portion.

To the front end of the nose cylinder is connected at an angle thereto a bolt or screw feeding tube connected to a suitable source which supplies the screw one at a time to the front end of the nose cylinder.

However, in the prior art automatic screwdriver, the nose and hand grip cylinders are only capable of telescoping with respect to each other so that the nose cylinder is not capable of being adjusted to take any desired angular position with respect to the hand grip cylinder. If the working area presents an obstacle which stands in the way of the feeder tube, the whole unit must be rotated to avoid disturbance. However, since the hand grip portion of the apparatus is usually connected to a power source such as source of pressurized air via a conduit and since this conduit is not flexible enough to permit a substantial amount of rotation, it is often difficult or impossible to avoid the hindrance of objects which might be present in working areas.

SUMMARY OF THE INVENTION

A solution to this problem is obtained by the provision of a pair of complementary tapered contacting surfaces, one of which is provided on a first cylindrical member having a hand grip portion and a guide portion over which a second cylindrical member is adapted to telescope. The other contacting surface is provided on the internal wall of a third cylindrical member which encircles the guide portion and slidably mounted at one end over the second cylindrical member which is the nose portion of the screwdriver. A manually operable means is provided to provide a pressure contact between the two tapered contacting surfaces so that when the apparatus is in operation the first and second cylindrical members are firmly secured together. The manually operable means is operative to decouple the two contacting surfaces when it is desired to rotate the nose cylinder to a desired angular position with respect to the hand grip cylinder.

Preferably, the manually operable means comprises an adjusting nut having a bore through which the first cylindrical member slidably extends and an inwardly extending flange which is adapted to come into abutment contact with a flanged portion of the first cylindrical member adjacent to the contacting surfaces. The nut is manually threadably engaged with an externally threaded portion of the third cylindrical member encircling the guide portion, so that when the nut is tightened to the fullest extent the two contacting surfaces provide a firm gripping contact between the first and second cylindrical members.

BRIEF DESCRIPTION OF THE DRAWINGS

Disadvantages of the prior art screwdriver and advantages of the present invention will become apparent from the following description with reference to the accompanying drawings, in which.

DETAILED DESCRIPTION

Figure 1:
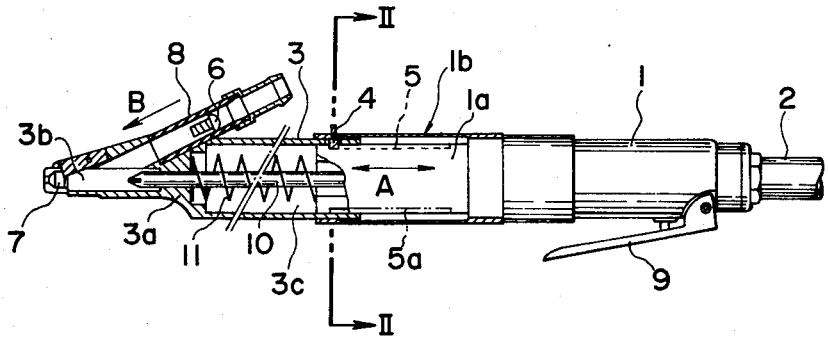
FIG. 1 PRIOR ART
FIG. 1 is an illustration of the prior art automatic power-driven screwdriver.

Before describing the present invention reference is first made to FIG. 1 in which the conventional automatic power-driven screwdriver is illustrated. The conventional screwdriver comprises two structual elements generally in the shape of cylinders which form a hand grip portion 1 connected to a pneumatic tube 2 and a nose portion 3 which telescopes with respect to the hand grip portion 1. The hand grip cylinder 1 has an axial throughbore in which is mounted a turbine fan or any other well known means (not shown) for converting the pumped pressure of air introduced through the tube 2 from a source of pressurized air (not shown) into rotational motion. Numeral 9 is a hand-operated lever attached to the cylinder 1. This lever is operatively connected to a clutch mechanism (not shown) mounted in the cylinder 1 to selectively couple and decouple the shaft of the turbine fan to a screwdriver bit 10 which extends into the interior of the nose cylinder 3, so that when the operator firmly grips the lever 9 the bit 10 will be caused to rotate about its axis. The hand grip cylinder 1 is provided with a guide cylinder 1*a* having an axially extending groove 5, and a cylindrical cover 1*b* extending over the length of the guide cylinder 1*a*.

Figure 2:
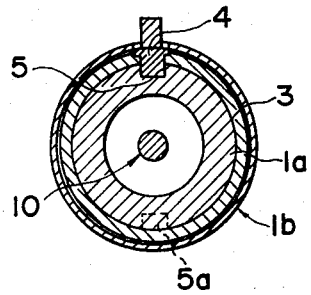
FIG. 2 PRIOR ART
FIG. 2 is a cross-sectional view taken along the lines II—II of FIG. 1.

In the nose cylinder 3 is provided an intermediate wall 3*a* which defines a forward chamber 3*b* and a rearward chamber 3*c* in which a compression spring 11 is mounted to urge the nose cylinder 3 away from the grip cylinder 1, so that the screwdriver is normally in an extended position in which the the bit 10 is retracted from the forward end of the nose cylinder 3. Into the forward chamber 3*b* extends a bolt supply tube 8 at an angle to the axis of the nose cylinder 3, the tube 8 being connected to a bolt supply source (not shown) which is conventionally designed to supply bolts 6 one at a time to the forward chamber 3*b* to cause the bolt to be seated in the forward end 7 with its threaded shank extending from the tip end 7. As shown in FIG. 2, the nose cylinder 3 is provided with a key 4 which engages the axial groove 5 of the guide cylinder 1*a* so that the angular position of the nose cylinder and hence the bolt supply tube is determined uniquely by the angular position of the hand grip cylinder 1.

One disadvantage of the prior art screwdriver is that since the angular position of the supply tube 8 cannot be adjusted independently of the hand grip cylinder 1, difficulties are often encountered when the working area presents an obstacle which stands in the way of the bolt supply tube 8, thus requiring that the whole structure be turned about its axis to gain access to the desired location undisturbed by the obstacle. Since the tube 2 is not flexible enough to provide a substantial degree of rotation about its axis, the obstacle may, in some instances, prevent the screwdriver from gaining access to the desired location into which the bolt 6 is driven. A solution to this problem would be to provide another axially extending groove 5*a* as shown in broken lines in FIG. 2 in a position diametrically opposite to the groove 5. By manually removing the key 4 from the groove 5 and inserting it into the groove 5*a* by rotating the nose cylinder 3 by 180 degrees with respect to the hand grip cylinder 1. A further disadvantage is that the conventional screwdriver cannot easily be disassembled for checking purposes. This can be done only by removing the key 4 from the groove 5, which operation is cumbersome.

Figure 3:
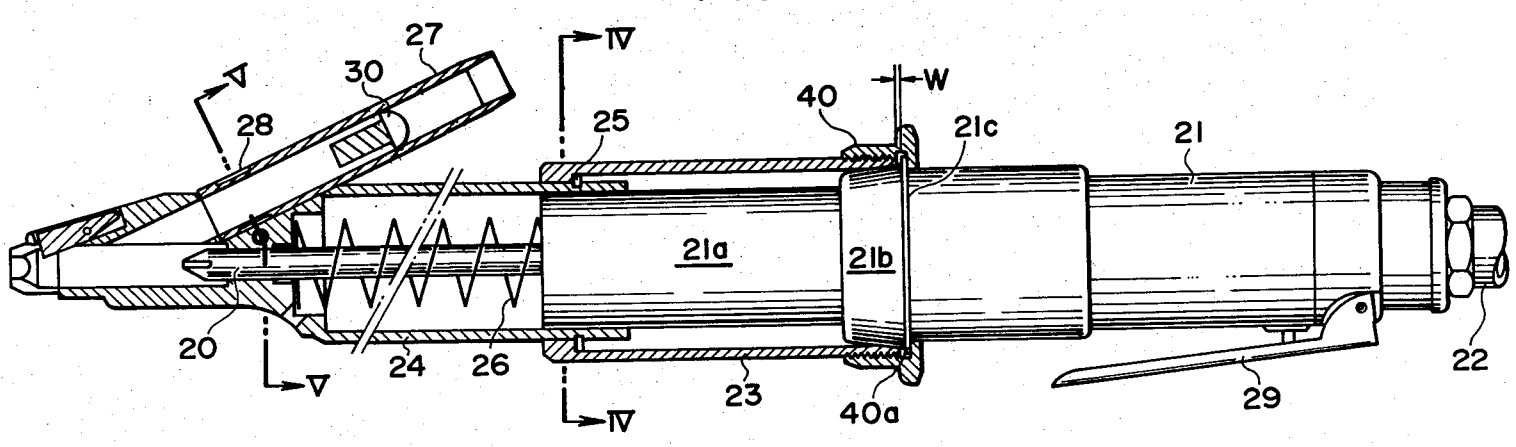
FIG. 3 is an illustration of the automatic screwdriver according to the invention.

The apparatus of the invention is illustrated in FIGS. 3 to 6. In FIG. 3, the screwdriver comprises, in the same manner as in the prior art apparatus, two telescoping cylinders 21 and 24, the cylinder 21 being the hand grip portion connected to the pneumatic tube 22 and provided with a hand lever 29 and the cylinder 24 being the nose portion which telescopes over the guide cylinder 21*a* integrally formed with the cylinders 21. Between the guide cylinders 21*a* and the hand grip portion 21 is formed a tapered section 21*b* of which the diameter gradually increases in a direction away from the forward end of the screwdriver. At the rear end of the tapered section 21*b* is formed a flange 21*c* which serves as an abutment surface with which an adjusting nut engages as will be described hereinbelow.

Over the length of the guide cylinder 21*a* extends a cylindrical cover member 23 as in the prior art apparatus. This cover member differs in structure from the member 1*b* of the prior art screwdriver in that it has a tapered inner wall at the rear end thereof so shaped that it presents a surface complementary to the outer face of the tapered section 21*b*. Around the outer periphery of the cover member 23 is a threaded portion with which the adjusting nut 40 engages. The adjusting nut 40 is formed with a flange 40*a* which comes into abutment contact with the flange 21*c* when the nut is tightened to the fullest extent. In this condition, there is a gap "W" between the flange 21*b* and the rearend of the cover member 23. This allows the cover member 23 and the tapered section 21*b* to come into face-to-face contact with each other, whereby the hand grip cylinder 21 and nose cylinder 24 are firmly secured together. Therefore, the nose cylinder 24 can be readjusted to take a desired angular position with respect to the hand grip cylinder 21 by simply loosening the adjusting nut 40. By the provision of the nut 40, the nose cylinder 24 can be easily detached from the grip cylinder 21 for purposes of inspection.

Figure 4:
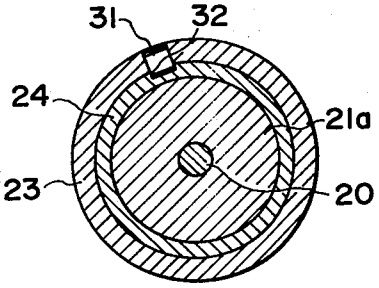
FIG. 4 is a cross-sectional view taken along the lines IV—IV of FIG. 3.

The nose cylinder 24 is provided with a stopper ring 25 which comes into contact with an inwardly flanged portion of the cover member 23 to prevent the cylinder 24 from coming off the hand grip cylinder 21 when the screwdriver is extended by means of the compression spring 26. As shown in FIG. 4, a key 31 is secured to the outer cover member 23 and is positioned to engage an axial guide groove 32 provided on the outer surface of the inner guide cylinder 24, whereby once the adjusting nut 40 is tightened the nose cylinder 24 is prevented from rotating freely with respect to the hand grip portion 21.

Figure 6:
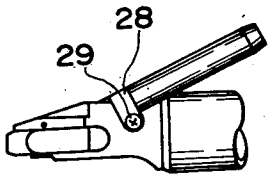
FIG. 6 is a side view of the front end of the screwdriver of FIG. 3.
Figure 5:
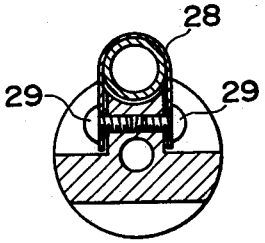
FIG. 5 is a cross-sectional view taken along the lines V—V of FIG. 3.

The bolt feeding tube 27 is provided in the same manner as in the prior art apparatus, this tube being secured to the nose member 24 by means of a metal strap member 28 and a pair of bolts 29 as illustrated in FIGS. 5 and 6. A hand operated lever 29 is also pivotally attached to the hand grip member 21 as in the prior art apparatus to transmit rotational power to the screwdriver bit 20.

With a bolt 30 being held in place at the front end of the nose cylinder 24, the screwdriver is directed to a threaded mating hole and the operator presses the hand grip cylinder 21 against the action of the spring 26 and then presses the hand lever 29 toward the cylinder 21. The bit 20 automatically comes into engagement with the bolt head and drives it into the thread hole.

What is claimed is:

1. An automatic screwdriver having a power unit, comprising: a first cylindrical member having a bore extending therethrough, a hand grip portion, a guide portion and a contacting surface portion between said hand grip and guide portions, a hand-operated lever pivotally mounted on said hand grip portion; a screw driving bit adapted to be rotatably driven by said power unit under the control of said hand-operated lever; a second cylindrical member mounted to telescope over said guide portion; means for biasing said second cylindrical member away from said first cylindrical member; a feeder tube connected at one end to a front end of said second cylindrical member at an angle thereto for feeding a bolt or the like to the front end of said second cylindrical member; a third cylindrical member extending over said guide portion and movably mounted on said second member and having a contacting surface engageable with the contacting surface of said contacting surface portion; manually operable means for providing pressure contact between said contacting surfaces to couple said first and second cylindrical members together, said manually operable means being operable to decouple said contacting surfaces to allow said second cylindrical member to rotate manually to a desired angular position with respect to said first cylindrical member; and means for coupling said second and third cylindrical members to provide unitary rotation about their axes when said first and second cylindrical members are decoupled from one another and to allow said second cylindrical member to telescope with respect to said third cylindrical member.

2. An automatic screwdriver as claimed in claim 1, wherein said contacting surface portion has an increasing diameter in a direction toward said hand grip portion to define a tapered contacting surface, and wherein said contacting surface of said third cylindrical member is complementary to said tapered contacting surface.

3. An automatic screwdriver as claimed in claim 2, wherein said manually operable means comprises an adjusting nut having a bore through which said first cylindrical member slidably extends, an internally threaded portion and an inwardly extending flange, and wherein said first cylindrical member is formed with a flanged portion between said tapered contacting surface portion and said hand grip portion, and wherein said third cylindrical member is formed with an externally threaded portion adjacent to said complementary contacting surface, said adjusting nut being manually threadably engageable with said externally threaded portion of the third cylindrical member to provide pressure contact between said contacting surfaces, said inwardly extending flange of said adjusting nut being in abutment contact with said flanged portion when said pressure contact is achieved.

* * * * *